United States Patent [19]

Huperz

[11] Patent Number: 4,634,353

[45] Date of Patent: Jan. 6, 1987

[54] VALVE HEAD FOR HIGH-PRESSURE PUMPS

[75] Inventor: Adalbert Huperz, Hockenheim, Fed. Rep. of Germany

[73] Assignee: Woma-Apparatebau Wolfgand Maasberg & Co. GmbH, Duisburg, Fed. Rep. of Germany

[21] Appl. No.: 704,399

[22] Filed: Feb. 22, 1985

[30] Foreign Application Priority Data

Feb. 25, 1984 [DE] Fed. Rep. of Germany ..... 3406850

[51] Int. Cl.[4] ..... F04B 21/02

[52] U.S. Cl. ..... 417/564; 417/568

[58] Field of Search ..... 137/454.4; 417/567, 417/564, 454, 568

[56] References Cited

U.S. PATENT DOCUMENTS

| | | | |
|---|---|---|---|
| 2,843,044 | 7/1958 | Mashiuter | 417/567 |
| 3,277,837 | 10/1966 | Pangborn | 417/454 |
| 3,323,467 | 6/1967 | Heintz | 417/454 |
| 3,510,233 | 5/1970 | Strebel | 417/454 |
| 4,456,440 | 6/1984 | Korner | 417/568 |
| 4,551,077 | 11/1985 | Pacht | 417/454 |

*Primary Examiner*—Carlton R. Croyle
*Assistant Examiner*—Theodore W. Olds
*Attorney, Agent, or Firm*—Prutzman, Kalb, Chilton & Alix

[57] ABSTRACT

In a pump valve head for a high-pressure pump having at least three pistons, the axial support of the parts surrounding the inlet valve in the intake connection is hydrostatically enhanced. For this purpose, a fluid flow path is provided between the interior space of the intake connection adjacent the end of the side thereof which faces away from the pump cylinder space, said flow path communicating with an intermediate space between a terminal portion of the inlet valve and a closure member affixed to the intake connection, and a region downstream of the pressure valves of the pump discharge connection. This fluid flow path includes a port in a bushing surrounding the pressure valve as well as annular gaps on the outside periphery of a bushing surrounding the pressure valve, a manifold bushing surrounding a pump plunger and a bushing surrounding the inlet valve.

13 Claims, 2 Drawing Figures

VALVE HEAD FOR HIGH-PRESSURE PUMPS

BACKGROUND OF THE INVENTION

1. Field of the Invention

The present invention relates to enhancing the service life of high-pressure pumps and particularly the valve heads of multi-piston pumps. More specifically, this invention is directed to valve heads for pumps and especially to armoured valve heads which include fluidic compensators to minimize component wear. Accordingly, the general objects of the present invention are to provide novel and improved methods and apparatus of such character.

2. Description of the Prior Art

While not limited thereto in its utility, the present invention is particularly well-suited for use in and as a valve head for multi-piston high-pressure pumps. Such pump valve heads include a housing connected to each pump cylinder and having, oppositely disposed from one another with respect to the pump cylinder, intake and pressure connections. The intake connection includes a fluid intake line and an inlet valve. The pressure connection includes a pressure or discharge line and a pressure or discharge valve. The formation of cracks in the components of such pump valve heads, due to high stresses in the region of the pump cylinder, is a well-known and persistent problem in the art. The reason for the formation of such cracks, i.e., the cause of the metal fatigue in the components of the valve heads for high-pressure pumps, will be discussed in further detail below.

Several attempts have previously been made to address the problem of crack formation in pump valve head components. Thus, by way of example, published British Patent Application No. 1,027,934 shows a pump valve head wherein the valve head housing is provided with a central bore and, in both the intake connection and the pressure connection, a cross-bore branching off the central bore is provided. In the arrangement of G.B.-A No. 1,027,934 a manifold bushing is fitted and braced in the central bore and bushings which define the pump intake port and the pressure or discharge port are fitted and braced in the cross bores. The bushings which define the intake and pressure ports respectively surround the inlet valve and pressure valve. The manifold bushing is designed to function as an armoured bushing and is fitted into the central bore of the valve head housing in such a manner as to define a sealed-off annular gap. The bushing which surrounds the pressure valve is provided with at least one radial passage through which the pressurized fluid discharged from the pump cylinder may flow. An arrangement of the type disclosed in G.B.-A No. 1,027,934 has been found to afford inadequate protection against stress crack formation, particularly in the region of the pressure and inlet valves.

Published German Patent Application No. 2,940,606 depicts another approach to protection of all highly-stressed pump head zones against crack formation. In the technique of this German Application the bushings surrounding the pressure and inlet valves are formed as armoured bushings and are fitted into the respective cross-bores in such a manner as to define annular spaces. Fluid communication is established, via a bore in the bushing surrounding the pressure valve, between a receiver region downstream of the pressure valve and the annular gap surrounding the pressure-side bushing. The latter annular gap is, in turn, connected via passages with the annular gap around the intake-side armoured bushing. Both annular gaps are sealed so as to prevent discharge of pressurized fluid provided thereto to thereby form a pressurized fluid jacket which effectively surrounds all of the armoured bushings. A pump head design of the type disclosed in published German Application No. 2,940,606 is known in the art as a hydrostatically armoured pump head.

Field tests have shown that, particularly in the case of multi-piston pumps which supply fluid at a pressure in excess of 1,300 bar, the mechanical connections established between of the internal parts, as provided by conventional axial threads, is inadequate on the intake side of the pump head even in the case of previous "hydrostatically armoured" pump heads. That is, in the case of valve heads of the type shown in published German Application No. 2,940,606, the components forming the valve head on the intake side are held in their desired relationship by means of manually applied axial thread force. When a working pressure of approximately 1,300 bar is exceeded, elastic deformations occur and these deformations are cyclic, i.e., occur in time with pump surges. These elastic deformations cause the formation of clearances between the stacked components of the structural valve elements arranged on the intake side. When the forces are relieved, and thus the clearances resulting from elastic deformation disappear, the components of the valve head impact against one another with considerable force and, in prolonged operation, damage resulting from metal fatigue will occur.

SUMMARY OF THE INVENTION

The present invention overcomes the above-briefly discussed and other deficiencies and disadvantages of the prior art by providing a pump valve head in which the internal parts of the head at the intake side are mechanically interconnected and are supported in a manner which avoids damage even in the case of prolonged operation at high working pressure. The present invention also encompasses a technique for the fluidic, and particularly hydrostatic, loading of the components on the intake side of a high pressure pump valve head so as to eliminate damage resulting from impact in the case of relative movement between components resulting from elastic deformation.

The objects of the present invention are achieved by establishing a fluid connection between a region downstream of the pressure or discharge valve or valves of the pump and the interior space of the intake connection, and particularly an intermediate space between a terminal part, for example a face plate, of the inlet valve and a closure member of the intake connection. This fluidic connection, in the preferred embodiment, is defined by a port in a bushing, the part surrounds the pressure valve which communicating with annular gaps about the periphery of the said bushing and both a manifold bushing and a bushing which surrounds the inlet valve. A further passage is provided between the aforesaid annular gaps and the above-mentioned intermediate space.

The technique of the present invention is, accordingly, the application of the working pressure, i.e., the pressure downstream of the pressure or discharge valves, to a region behind the connection part of the intake valve. This pressure, in the case of a multi-piston pump, will be quasi-static. This quasi-static pressure is applied, directly or indirectly, to a face plate, which supports the intake valve seat defining member. In one embodiment the pressure is applied to a piston disk which is mechanically coupled to such a face plate by means of a spacer. The net effect is that all of the fitted parts in the valve body on the intake side are urged together by a pre-tensioning force appropriate for the operating requirements. This pre-tensioning force will adapt automatically to each operating state since it depends upon the instantaneous delivery pressure.

BRIEF DESCRIPTION OF THE DRAWING

The present invention may be better understood and its numerous objects and advantages will become apparent to those skilled in the art by reference to the accompanying drawing wherein like reference numerals refer to like elements in the two FIGURES and in which.

DESCRIPTION OF THE DISCLOSED EMBODIMENT

Figure 1:
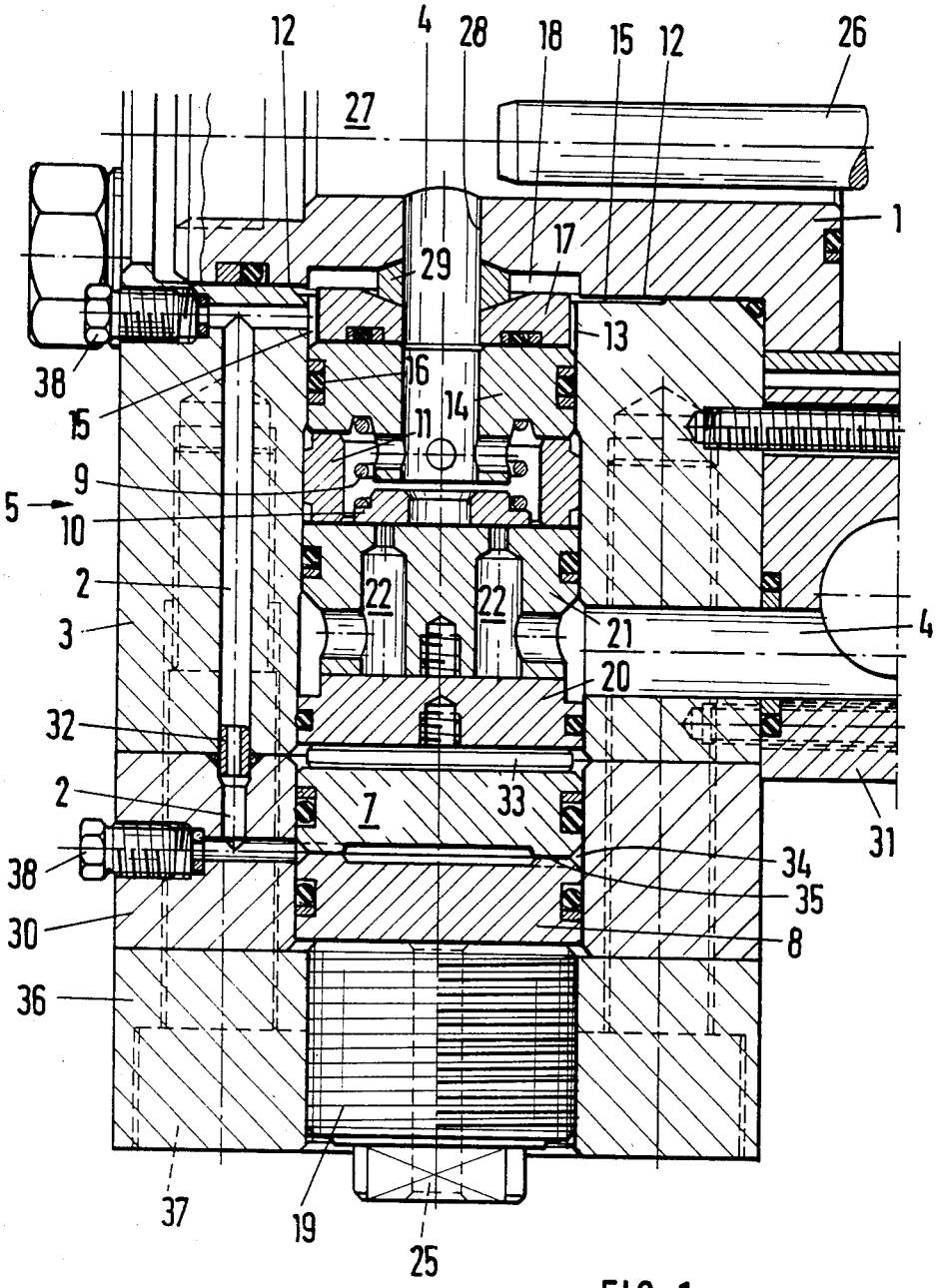
FIG. 1 is a partial cross-sectional side elevation view of a pump valve head in accordance with a first embodiment of the present invention, FIG. 1 depicting only the intake side of the head.

With reference now to FIG. 1, a pump valve head in accordance with the present invention is mounted on a pump cylinder block, not shown. The pump valve head includes a manifold bushing 1 having a passage therein which in part defines a cylinder 27 which receives the end of a pump piston or plunger 26. The pump valve head also includes an intake connector 3 which is provided with a central bore 12 for receiving manifold bushing 1. The intake connector 3 is also provided with a cross-bore 13 which, as will be described in greater detail below, receives the components which in part define a generally L-shaped intake passage 4. An inlet or suction valve, indicated generally at 5, is disposed in bore 13 of connector 3 so as to establish or interrupt fluid communication via intake passage 4 between cylinder 27 and an upstream portion of passage 4 which is formed in a housing 31 which is affixed to connector 3. The discharge end of passage 4 is defined by a flow bore 28 in manifold bushing 1. The inlet valve 5 includes a mounting block 21, which functions as the apertured valve seat, a valve disc 10 and a biasing spring 9.

An annular armoured bushing 11 is also positioned in bore 13 so as to be co-axial with and surround the valve spring 9 and valve disc 10. The bushing 11 contacts, at its upstream end, the mounting block 21 which defines the valve seat. The mounting block 21 is, in the disclosed embodiment, provided with a plurality of flow passages 22 which are in axial registration with uninterrupted portions of disc 10. On the side opposite to that which is in contact with the armoured bushing 11, the mounting block 21 contacts a surface of a face plate 20.

On the side opposite to that which contacts mounting block 21, i.e., at its downstream end, the armoured bushing 11 is in contact with a first surface of a further bushing 14. The second, oppositely disposed surface of bushing 14 contacts a first planar surface of a bushing 17. Bushing 14 is sealed to the wall of the bore 13 by means of an 0-ring seal 16 and similar seals are disposed between bushings 14 and 17, between mounting block 21 and the wall of bore 13 and between face plate 20 and the wall of bore 13. Bushing 17 has a smaller diameter when compared to bushing 14 whereby an annular gap 15 is defined between bushing 17 and the wall of bore 13. The centering of bushing 17, to insure that the gap 15 will always be present, is achieved by providing oppositely facing frustroconical grooves in manifold bushing 1 and bushing 17 at the side of passage 4. A double-tapered sealing ring 29, which has a lens like shape complementary to that of the frustroconical grooves in bushings 1 and 17, is captured between bushings 1 and 17 to insure the above-discussed requisite positioning of bushing 17. As may be seen from FIG. 2, bushing 14 and bushing 17, if present, will also in part define a discharge passage from cyilnder 27.

Figure 2:
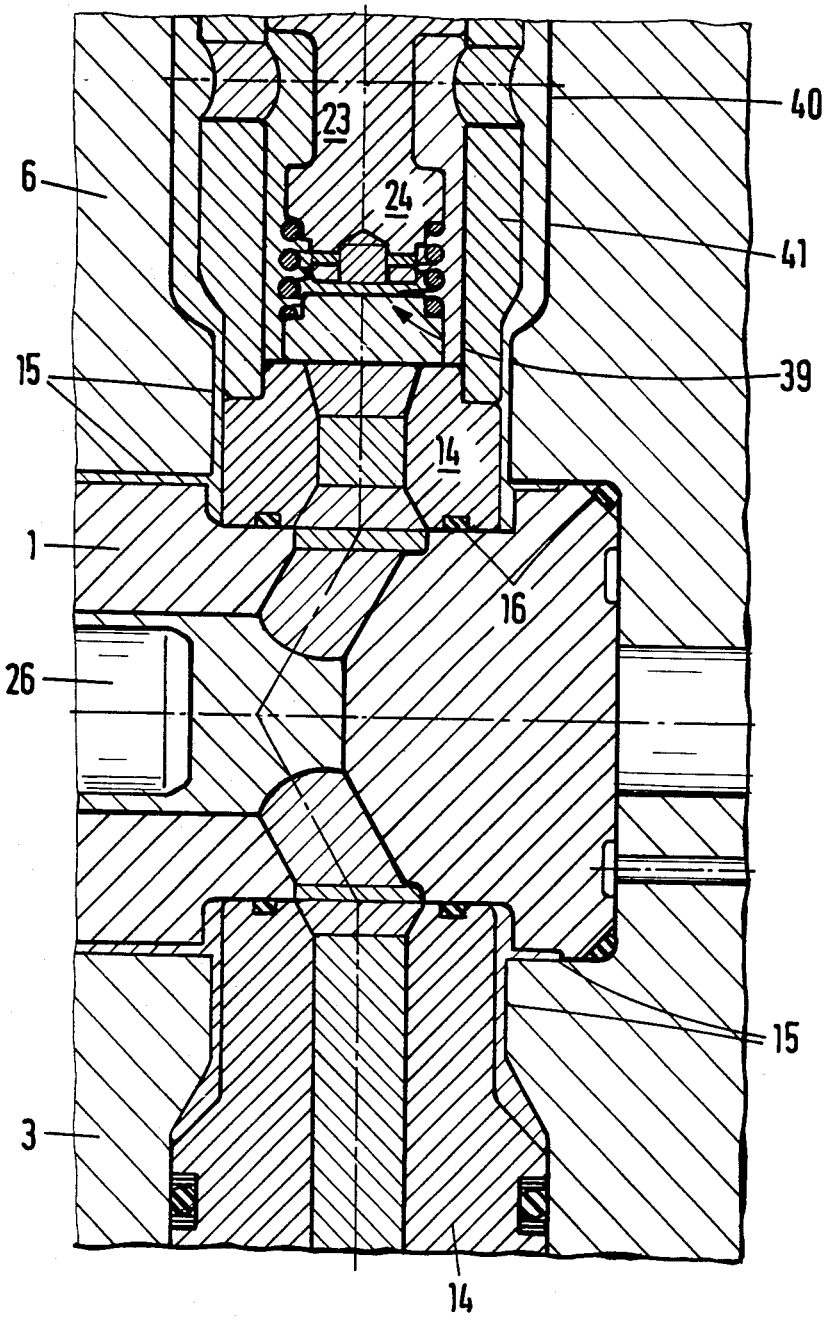
FIG. 2 is a schematic partial cross-sectional view of a pump valve head in accordance with the present invention, FIG. 2 depicting the pressure, i.e., discharge, side of the head and also showing, in simplified schematic form, part of the intake side of the head.

The manifold bushing 1 is provided, in the vacinity of the sealing ring 29, with an annular recess 18 which is in fluid communication with the annular gap 15 about the periphery of bushing 17, recess 18 being sealed from passage 4 by sealing ring 29. The connector 3 is provided with a flow passage 2 which extends between the annular gap 15 and the region of the abutting faces of a pair of piston discs 7 and 8 which are disposed in a bore or cylinder behind face plate 20. In actual practice, the flow passage 2 extends longitudinally from intake connection 3 into a cylinder defining plate 30 and a centering bushing 32 will be employed to insure alignment of the bores in connector 3 and plate 30 which cooperate to form passage 2. The plate 30 defines an extension of the bore 13 in which the piston discs 7 and 8 of a compensator are positioned. The discs 7 and 8 are sealed, by means of conventional O-ring seals, to the walls of the "cylinder" in plate 30. The passage 2 terminates at an annular space 34 defined by recesses machined in the piston discs 7 and 8. The annular space 34 is in fluid communication with a plurality, preferably three, of radial grooves 35 formed in one or both of the facing surfaces of discs 7 and 8. The discs 7 and 8 are capable of limited movement in the axial direction in cylinder plate 30 and thus relative to bore 13. The upper piston disc 7 is mechanically coupled to face plate 20 by a spacer disc 33. The combination of the cylinder plate 30 and the piston discs 7 and 8 will preferably be formed as a modular sub-assembly which is suitable for use in retrofitting. The piston discs 7 and 8 are captured in cylinder plate 30 by means of a screw-type closure 19. The screw-type closure 19 engages a flange 36 which, in turn, is affixed to the intake connector 3 by means of screws 37. The screw closure 19 is provided with a vent bore 25. The ends of the radial passages formed in inlet connector 3 and cylinder plate 30 in the course of machining flow passage 2, these passages being transverse to the flow passage 4, are capped by means of threaded fittings 38 as shown. The manner in which the annular gap 15, passage 2 and region between discs 7 and 8 is pressurized to the level of the pump discharge pressure will become apparent from the description of FIG. 2. The apparatus of FIG. 2 is, at the intake side of the pump head, a somewhat simplified version of that of FIG. 1. Thus, by way of example, in the FIG. 2 embodiment a single bushing 14' replaces bushings 14 and 17 and sealing ring 29 of the FIG. 1 embodiment. In FIG. 2, the pressure connection whereby fluid at the pump discharge pressure is fed back to the intake side of the pump valve head is indicated generally at 6. As may be seen from FIG. 2, a pin 23 projects into the armoured bushing 41 which is positioned so as to contact the armoured bushing 14'. The pin 23 anchors the biasing spring of a pressure valve, indicated generally at 39, as shown. The bushing 41 is provided with radial flow ports 40 which communicate with the above-described annular gap 15. As may clearly be seen from FIG. 2, particularly as represented by the shading thereon, when the pressure valve 39 opens fluid at the pump delivery pressure will be fed back into the annular gap 15 and thus will effectively sheath the manifold bushing 1 and the armoured bushing 14. These components, accordingly, are essentially pretensioned by an external pressure and thus can withstand higher delivery pressures than would otherwise be possible without damage. The present invention, accordingly, is an armoured valve head which is provided with a fluidic compensator.

In the operation of the embodiment of the invention shown in FIG. 1, when the pump which is associated with the valve head is operating, the pump delivery or discharge pressure will be transmitted from the downstream side of a pressure valve, such as valve 39 of FIG. 2, via radial flow ports in a bushing, such as bushing 41, into the annular gaps 15 and, via the flow passage 2, to the intermediate space between the piston discs 7 and 8. This feedback of pressurized fluid insures a non-positive connection between those components of the valve head which are "stacked" in bore 13. That is, the greater the pump discharge pressure, the greater will be the force with which the various bushings, mounting block and face plate are urged together. The screw closure 19, held by the flange 36 and fastening screws 37, causes the fitted parts in the pressure connector 6 and in the intake connector 3 and the manifold bushing 1 to be held firmly together.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a valve head for a high pressure pump, the valve head including a housing connected to a cylinder defining block of the pump, the valve head housing defining intake and discharge connections which are in fluid communication with a pump cylinder, the valve head intake connection including means defining an intake passage having an inlet valve mounted therein, the inlet valve having a valve seat and a valve member which is relatively movable relating thereto, the discharge connection including a discharge passage and a discharge valve which cooperates therewith, the improvement comprising:

a chamber in the valve head housing which communicates with the intake connection, said chamber being at least in part in alignment with the intake valve head housing further including a closure member for the chamber disposed at an opposite side of the chamber with respect to the intake valve; chamber, pressure compensator means disposed in said chamber, said compensator means being mechanically coupled to the intake valve seat and being axially movable relative to the intake valve seat; and means establishing fluid communication between the discharge passage at a point downstream of the discharge valve and the interior of said chamber in the region between said compensator means and said closure means whereby a force commensurate with the pump discharge pressure will be developed by said compensator means and applied to the inlet valve seat.

2. A valve head according to claim 1 wherein said fluid communication establishing means comprises a first bushing surrounding the discharge valve, said bushing having at least one flow port extending therethrough, said fluid communication establishing means further comprising a first annular space about at least a portion of said bushing, said first annular space being in communication with the discharge passage downstream of the discharge valve via said flow port, said fluid communication establishing means also comprising a manifold bushing which defines a second space located between said manifold bushing and the valve head housing, said second space being in fluid communication with said first annular space, said fluid communication establishing means additionally comprising a fluid flow passage which extends between said second space and said chamber.

3. A valve head according to claim 1 wherein said compensator means comprises at least first piston means positioned in said chamber, said fluid communication establishing means terminating in said chamber at a point intermediate said first piston means and said closure member.

4. A valve head according to claim 2 wherein said compensator means comprises at least first piston means positioned in said chamber, said fluid flow passage terminating at one end in said chamber intermediate said first piston means and said closure member.

5. A valve according to claim 1 wherein said closure member includes second piston which said first piston means and wherein said compensator means includes means coupling said first piston means to an intake passage defining means, pressurized fluid at the pump discharge being delivered to the space between said first and second piston means, the forces developed by said first piston means being transmitted to the intake passage defining means and into the inlet valve seat via the intake passage defining means.

6. A valve according to claim 3 wherein said closure member includes second piston means which abuts said first piston means and wherein said compensator means includes means coupling said first piston means to an intake passage defining means, pressurized fluid at the pump discharge being delivered to the space between said first and second piston means, the forces developed by said piston means being transmitted to the intake passage defining means and into the inlet valve seat via the intake passage defining means.

7. A valve head according to claim 2 wherein said second space of said fluid communication establishing means comprises an annular gap between said manifold bushing and the valve head housing and wherein said fluid flow passage is in part defined by a space between a second bushing and the valve head housing, said second bushing defining a portion of the intake passage which is located downstream of the intake valve.

8. A valve head according to claim 7 wherein said manifold bushing is provided with an aperture which defines the discharge end of the intake passage and wherein a portion of the intake passage between said manifold bushing aperture and said second bushing is defined by a tapered centering member having a passage extending therethrough.

9. A valve head according to claim 7 wherein the inlet valve seat is defined by a member having at least a first passage formed therein, said seat defining member abuting said first piston means.

10. A valve head according to claim 9 wherein the valve member of the intake valve is positioned in a cylinder defined a third bushing which abuts said seat defining member at a first end a second opposite and of said third bushing being mechanically coupled to said bushing.

11. A valve head according to claim 7 wherein said compensator means comprises at least first piston means positioned in said chamber, said fluid flow passage terminating at one end in said chamber intermediate said first piston means and said closure member.

12. A valve head according to claim 10 wherein said compensator means comprises at least first piston means positioned in said chamber, said fluid flow passage terminating at one end in said chamber intermediate said first piston means and said closure member.

13. A valve head according to claim 12 wherein said manifold bushing is provided with an aperture which defines the discharge end of the intake passage and wherein a portion of the intake passage between said menifold bushing aperture and said second bushing is defined by a tapered centering member having a passage extending therethrough.

* * * * *